US010836074B2

(12) United States Patent
Haiden

(10) Patent No.: US 10,836,074 B2
(45) Date of Patent: Nov. 17, 2020

(54) FELT FOR FORMING FIBER CEMENT ARTICLES AND RELATED METHODS

(71) Applicant: Huyck Licensco Inc., Youngsville, NC (US)

(72) Inventor: Klaus Haiden, Neunkirchen (AT)

(73) Assignee: HUYCK LICENSCO INC., Youngsville, NC (US)

( * ) Notice: Subject to any disclaimer, the term of this patent is extended or adjusted under 35 U.S.C. 154(b) by 188 days.

(21) Appl. No.: 16/123,395

(22) Filed: Sep. 6, 2018

(65) Prior Publication Data

US 2019/0168414 A1 Jun. 6, 2019

Related U.S. Application Data

(60) Provisional application No. 62/594,745, filed on Dec. 5, 2017.

(51) Int. Cl.
*D21F 1/00* (2006.01)
*D21F 7/08* (2006.01)
(Continued)

(52) U.S. Cl.
CPC ..... *B28B 1/527* (2013.01); *B28B 1/42* (2013.01); *B28B 1/526* (2013.01); *B28B 3/123* (2013.01);
(Continued)

(58) Field of Classification Search
CPC .... D21F 1/0027; D21F 1/0036; D21F 1/0045; D21F 7/08; D21F 7/083; D21F 7/10; D21F 7/12; D03D 3/04; D03D 11/00; D03D 25/00; D03D 2700/0155; D03D 2700/0159; D03D 2700/0162; D03D 2700/02; B28B 1/52; B28B 1/526; B28B 1/527; B28B 5/02; B28B 5/026; B28B 5/027; B28B 3/123; D21J 1/16; D21J 1/165; B32B 5/024
(Continued)

(56) References Cited

U.S. PATENT DOCUMENTS 4,216,043 A 8/1980 Gazzard et al.
6,284,678 B1 * 9/2001 Kobayashi ..... D03D 1/0094 139/394
(Continued)

FOREIGN PATENT DOCUMENTS

JP 7-328354 A 12/1995
JP H1190915 4/1999
JP H11323798 11/1999

OTHER PUBLICATIONS

International Search Report and Written Opinion corresponding to International Application No. PCT/US2018/049025 dated Dec. 18, 2018.
International Preliminary Report on Patentability corresponding to International Application No. PCT/US2018/049025 dated Jun. 18, 2020.

*Primary Examiner* — Eric Hug
(74) *Attorney, Agent, or Firm* — Myers Bigel, P.A.

(57) ABSTRACT

The present invention is directed to a fiber cement felt comprising repeat units, each of which includes top, middle, and bottom machine direction yarns and cross-machine direction yarns interwoven with the top, middle, and bottom machine direction yarns in a predetermined weave pattern. The top, middle, and bottom machine direction yarns may comprise effect yarns and linear yarns without the need for a batt layer.

22 Claims, 7 Drawing Sheets

(51) Int. Cl.

| | |
|---|---|
| ***B28B 1/52*** | (2006.01) |
| ***B28B 1/42*** | (2006.01) |
| ***D03D 11/00*** | (2006.01) |
| ***B28B 3/12*** | (2006.01) |
| *D21J 1/16* | (2006.01) |

(52) U.S. Cl.
CPC ..... *D03D 11/00* (2013.01); *D21F 1/00* (2013.01); *D21F 7/083* (2013.01); *D03D 2700/0114* (2013.01); *D21J 1/165* (2013.01)

(58) Field of Classification Search
USPC ..... 162/348, 358.2, 900, 902, 903; 139/383 A, 425 A; 264/86, 87
See application file for complete search history.

(56) References Cited

U.S. PATENT DOCUMENTS

| | | | | |
|---|---|---|---|---|
| 6,397,899 | B1 * | 6/2002 | Kobayashi | D21F 1/0036 139/383 A |
| 2002/0056483 | A1 | 5/2002 | Nagura | |
| 2003/0015248 | A1 * | 1/2003 | Itoh | D03D 11/00 139/420 R |
| 2005/0085148 | A1 * | 4/2005 | Baumgartner | B32B 9/047 442/279 |
| 2008/0006340 | A1 | 1/2008 | Nakajima | |
| 2008/0135200 | A1 * | 6/2008 | Harwood | D21F 1/0027 162/358.2 |

* cited by examiner

1000

1100

1200

1200

FELT FOR FORMING FIBER CEMENT ARTICLES AND RELATED METHODS

STATEMENT OF PRIORITY

The present application claims priority from and the benefit of U.S. Provisional Patent Application No. 62/594,745, filed Dec. 5, 2017, the disclosure of which is hereby incorporated herein in its entirety.

FIELD OF THE INVENTION

The present invention relates generally to fabrics, and more particularly to fabrics employed to form articles of fiber cement.

BACKGROUND OF THE INVENTION

Fiber cement is a well-known material employed in many building components, such as siding, roofing and interior structures, and in pipes, particularly for waste water transport. Fiber cement typically comprises a mixture of cement (i.e., lime, silica and alumina), clay, a thickener, inorganic fillers such as calcium carbonate, and one or more fibrous materials. In the past, asbestos was commonly included as the fibrous material (see, e.g., U.S. Pat. No. 4,216,043 to Gazzard et al.); because of the well-documented problems asbestos presents, now fiber cement typically includes a natural or synthetic fiber, such as acrylic, aramid, polyvinyl alcohol, polypropylene, cellulose or cotton. Fiber cement is popular for the aforementioned applications because of its combination of strength, rigidity, impact resistance, hydrolytic stability, and low thermal expansion contraction coefficient.

To be used in siding or roofing components, fiber cement is often formed in sheets or tubes that can be used "as is" or later cut or otherwise fashioned into a desired shape. One technique of forming fiber cement articles is known as the Hatschek process. A fiber cement forming apparatus using the Hatschek process typically includes a porous fabric belt positioned on a series of support rolls. An aqueous fiber cement slurry of the components described above is created and deposited as a thin sheet or web on the porous fabric belt. The slurry is conveyed by the fabric belt over and through a series of rollers to flatten and shape the slurry. As the slurry is conveyed, moisture contained therein drains through openings in the fabric. Moisture removal is typically augmented by the application of vacuum to the slurry through the fabric (usually via a suction box located beneath the porous fabric). After passing through a set of press rolls, the fiber cement web can be dried and cut into individual sheets, collected on a collection cylinder for subsequent unrolling and cutting into individual sheets, or collected as a series of overlying layers on a collecting cylinder that ultimately forms a fiber cement tube.

The porous fabric used to support the slurry as moisture is removed is typically woven from very coarse (between about 2500 and 3000 dtex) polyamide yarns. Most commonly, the yarns are woven in a "plain weave" pattern, although other patterns, such as twills and satins, have also been used. Once they are woven, the yarns are covered on the "sheet side" of the fabric (i.e., the side of the fabric that contacts the fiber cement slurry) with a batt layer; on some occasions, the "machine side" of the fabric (i.e., the side of the fabric that does not contact the slurry directly) is also covered with a batt layer. The batt layer assists in the retrieval, or "pick-up," of the slurry from a vat or other container for processing. Because of the presence of the batt layer(s), the fabric is typically referred to as a fiber cement "felt."

The connection between the base fabric and batt layer(s) is typically done mechanically during the needling process. During the needling process, it is common for the machine and cross-machine direction yarns to be damaged. The damaged yarns reduce the tensile strength of the fiber cement felt in both directions. It would be desirable to form a fiber cement felt without the need for a batt layer which would eliminate the needling process.

SUMMARY OF THE INVENTION

In one aspect, the invention is directed to a fiber cement felt comprising repeat units, each of which includes a plurality of top, middle, and bottom machine direction yarns and a plurality of cross-machine direction yarns interwoven with the plurality of top, middle, and bottom machine direction yarns in a predetermined weave pattern, wherein the plurality of top, middle, and bottom machine direction yarns comprises a plurality of effect yarns and a plurality of linear yarns, wherein at least some of the top machine direction yarns are effect yarns, and at least some of the bottom machine direction yarns are effect yarns.

Another aspect of the invention is directed to a fiber cement felt comprising repeat units, each of which includes a plurality of top and bottom machine direction yarns and a plurality of cross-machine direction yarns interwoven with the plurality of top and bottom machine direction yarns in a predetermined weave pattern, wherein the plurality of top and bottom machine direction yarns comprises a plurality of effect yarns and a plurality of linear yarns, wherein at least some of the top machine direction yarns are effect yarns and at least some of the bottom machine direction yarns are effect yarns, wherein at least some of the effect yarns in the plurality of top machine direction yarns are woven in pairs.

A further aspect of the invention is directed to a method of forming a fiber cement article, comprising the steps of: (a) providing a fiber cement felt, the fiber cement felt comprising: repeat units, each of which includes a plurality of top, middle, and bottom machine direction yarns and a plurality of cross-machine direction yarns interwoven with the plurality of top, middle, and bottom machine direction yarns in a predetermined weave pattern, wherein the plurality of top, middle, and bottom machine direction yarns comprises a plurality of effect yarns and a plurality of linear yarns, wherein at least some of the top machine direction yarns are effect yarns, and at least some of the bottom machine direction yarns are effect yarns; (b) positioning the fiber cement felt on a series of support rolls of a fiber cement forming machine; (c) depositing a fiber cement slurry on the fiber cement felt; and (d) removing moisture from the slurry to form a fiber cement web.

DETAILED DESCRIPTION OF EMBODIMENTS OF THE PRESENT INVENTION

Figure 1:
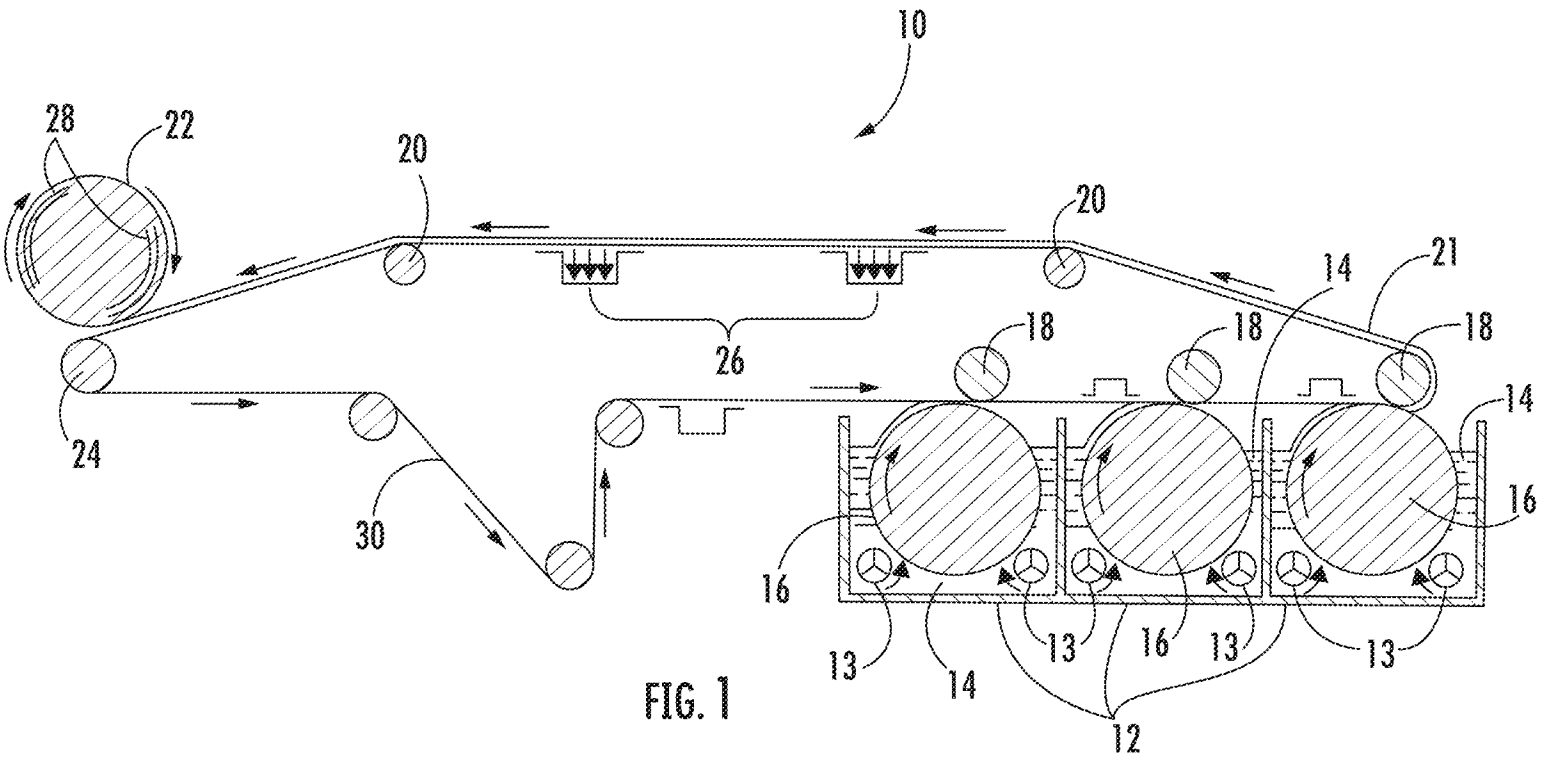
FIG. 1 is a schematic illustration of a fiber cement forming apparatus of the present invention.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

As used herein, the terms machine direction ("MD") and cross-machine direction ("CMD") refer, respectively, to a direction aligned with the direction of travel of the fiber cement felt on the fiber cement forming machine, and a direction parallel to the fabric surface and traverse to the direction of travel. Likewise, directional references to the vertical relationship of the yarns in the fabric (e.g., above, below, top, bottom, beneath, etc.) assume that the fiber cement making surface of the fabric is the top of the fabric and the machine side surface of the fabric is the bottom of the fabric.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper", "top", "middle", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

As used herein, "fiber cement" means any cementitious composition including cement, silica, and fiber for reinforcement, including asbestos, polyvinyl alcohol, polypropylene, cotton, wood or other cellulosic material, acrylic, and aramid. It is contemplated that other materials such as thickeners, clays, pigments, and the like, that impart desirable processing or performance characteristics to the fiber cement slurry or an article formed therefrom may also be included.

Well-known functions or constructions may not be described in detail for brevity and/or clarity.

Referring now to FIG. 1, a fiber cement forming apparatus, designated broadly at 10, is illustrated therein. The forming apparatus 10, which performs a typical Hatschek process, generally includes an endless fiber cement felt 30 positioned in rolling contact with and driven by a number of guide rolls 20. Starting in the lower right corner of FIG. 1, the felt 30 passes above three vats 12, each of which contains a batch of fiber cement slurry 14. Each vat 12 is positioned below a deposition cylinder 16 mated with a couch roll 18. Each vat 12 also includes agitators 13, which prevent the fiber cement slurry 14 from solidifying therein.

Rotation of each deposition cylinder 16 collects fiber cement slurry 14 on the cylinder's surface; as the felt 30 travels over and contacts the cylinder 16, the slurry 14 is transferred from the cylinder 16 to the felt 30. The amount of slurry 14 deposited on the fabric 30 by each cylinder 16 is controlled by the corresponding couch roll 18. Typically, the fiber cement slurry 14 is deposited as a web 21 at a thickness of between about 0.3 mm and 3 mm.

Still referring to FIG. 1, once the fiber cement slurry web 21 has been collected on the felt 30 from each of the vats 12, the felt 30 conveys the slurry web 21 over one guide roll 20, then over one or more suction boxes 26 (two are shown in FIG. 1), each of which applies negative pressure to the felt 30, thereby encouraging the removal of moisture from the slurry web 21. Finally, the felt 30 and the slurry web 21 pass over a second guide roll 20, then between the nip formed by a breast roll 24 and a forming roll 22. After passing through the nip, the slurry web 21 has formed into a semi-solid fiber cement sheet 28 that is collected on the surface of the forming roll 22.

Figure 2A:
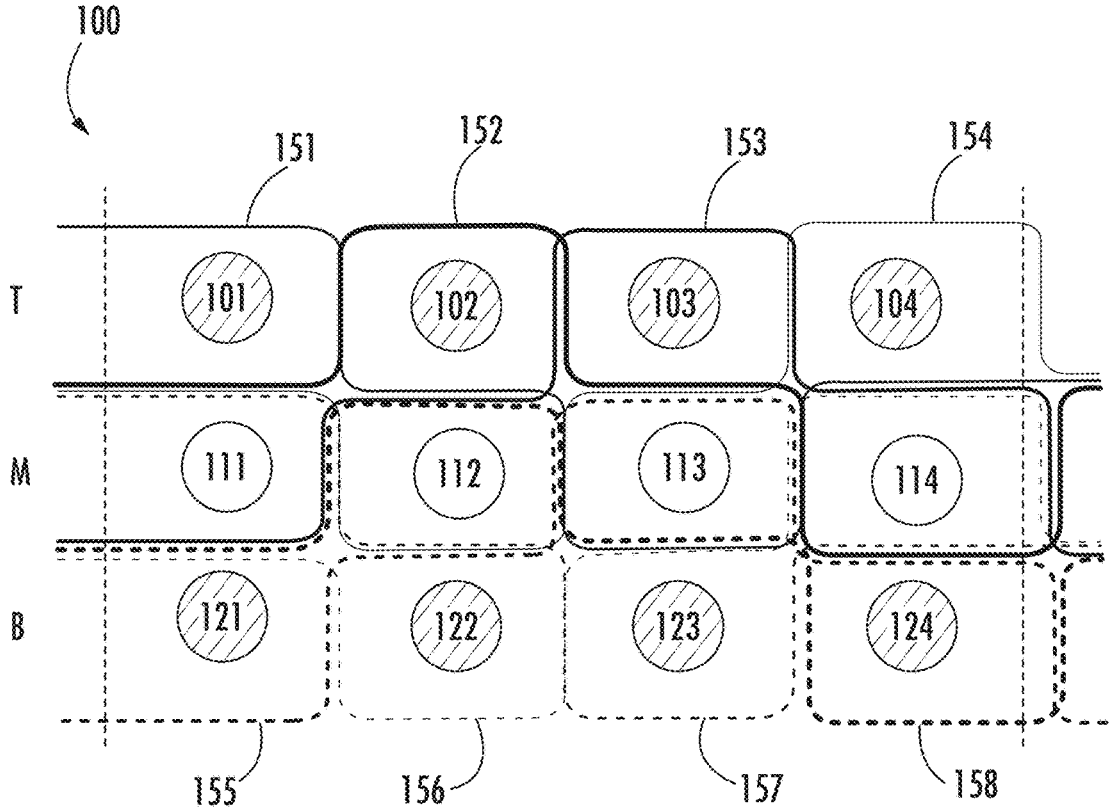
FIGS. 2A-2F are schematic section views of fiber cement felts according to embodiments of the present invention with repeat units that include top, middle, and bottom machine direction yarns and upper and lower cross-machine direction yarns.

A section of the fiber cement felt 100, according to embodiments of the invention, is shown in FIG. 2A. The fiber cement felt 100 has repeat units which include top (T) MD yarns (101-104), middle (M) MD yarns (111-114) and bottom (B) MD yarns (121-124) and CMD yarns (151-158) interwoven with each other in a predetermined weave pattern. This pattern repeats itself over the expanse of the fiber cement felt 100. For example, FIG. 2A illustrates a repeated weave pattern consisting of twelve MD yarns and eight CMD yarns.

In the fiber cement felt 100, the CMD yarns (151-158) may be monofilaments or twisted monofilament yarns. The MD yarns (101-104, 111-114, 121-124) may comprise effect yarns (cross-hatched) or linear yarns (not cross-hatched). As used herein, "effect yarn" is a general term for all kinds of yarns that are different from linear yarns. In general, effect yarns can be described as having a fibrous structure that extends radially outwardly of the backbone of the yarn. These types of yarns include, but are not limited to, chenille yarns (round or flat), DREF yarns, Bouclé yarns and knot yarns. Linear yarns are more conventional yarns that have substantially no radially extending structure and include, but are not limited to, monofilament or twisted monofilament yarns.

In some embodiments, the top, middle, and bottom MD yarns comprise effect yarns and linear yarns. In some embodiments, as least some of the top MD yarns are effect yarns and at least some of the bottom MD yarns are effect yarns. In some embodiments, the effect yarns are woven in pairs. In other embodiments, the effect yarns are woven in pairs with linear yarns. Different embodiments of the present invention will now be described in greater detail below.

FIGS. 2A-2F illustrate enlarged sections of the fiber cement felt according to embodiments of the present invention. Referring first to FIG. 2A, the fiber cement felt 100 includes repeat units that comprise four top (T) MD yarns (101-104), four middle (M) MD yarns (111-114), four bottom (B) MD yarns (121-124), four upper CMD yarns (151-154) and four lower CMD yarns (155-158) interwoven with the top, middle, and bottom MD yarns (101-104, 111-114, 121-124) in a predetermined weave pattern. The top MD yarns (101-104) and the bottom MD yarns (121-124) comprise effect yarns (cross-hatched). The middle MD yarns (111-114) comprise linear yarns (not cross-hatched).

Each of the upper CMD yarns (151-154) interweaves with the top MD yarns (101-104) and middle MD yarns (111-114) in a predetermined weave pattern. The upper CMD yarns pass over a top MD yarn, pass under the adjacent top MD yarn but above the middle MD yarn directly below, pass under the adjacent middle MD yarn but above the bottom MD yarn directly below, and pass over the next adjacent middle MD yarn but below the top MD yarn directly above. As an example, CMD yarn (151) passes over a top MD yarn (101), passes under the adjacent top MD yarn (102) but above the middle MD yarn (112) directly below, passes under the adjacent middle MD yarns (113) but above the bottom MD yarn (123) directly below, and passes over the adjacent middle MD yarn (114) but below the top MD yarn (104) directly above. The remaining upper CMD yarns (152-154) follow the same pattern as upper CMD yarn (151) but are each are offset by one top MD yarn.

Each of the lower CMD yarns (155-158) interweaves the middle (111-114) and bottom (121-124) MD yarns in a predetermined weave pattern. The lower CMD yarns pass under a bottom MD yarn, pass over the next adjacent bottom MD yarn but under the middle MD yarn directly above, and pass over the next adjacent middle MD yarn but under the top MD yarn directly above, pass under the next adjacent middle MD yarn but over the bottom MD yarn directly below. As an example, CMD yarn (155) passes under a bottom MD yarn (121), passes over the next adjacent bottom MD yarn (122) but under the middle MD yarn (112) directly above, and passes over the next adjacent middle MD yarn (113) but under the top MD yarn (103) directly above, passes under the next adjacent middle MD yarn (114) but over the bottom MD yarn (124) directly below. The remaining lower CMD yarns (156-158) follow the same pattern as upper CMD yarn (155) but are each offset by one bottom MD yarn. Those skilled in this art will recognize that other types of weaves can be employed in the fiber cement felt 100.

Figure 2B:
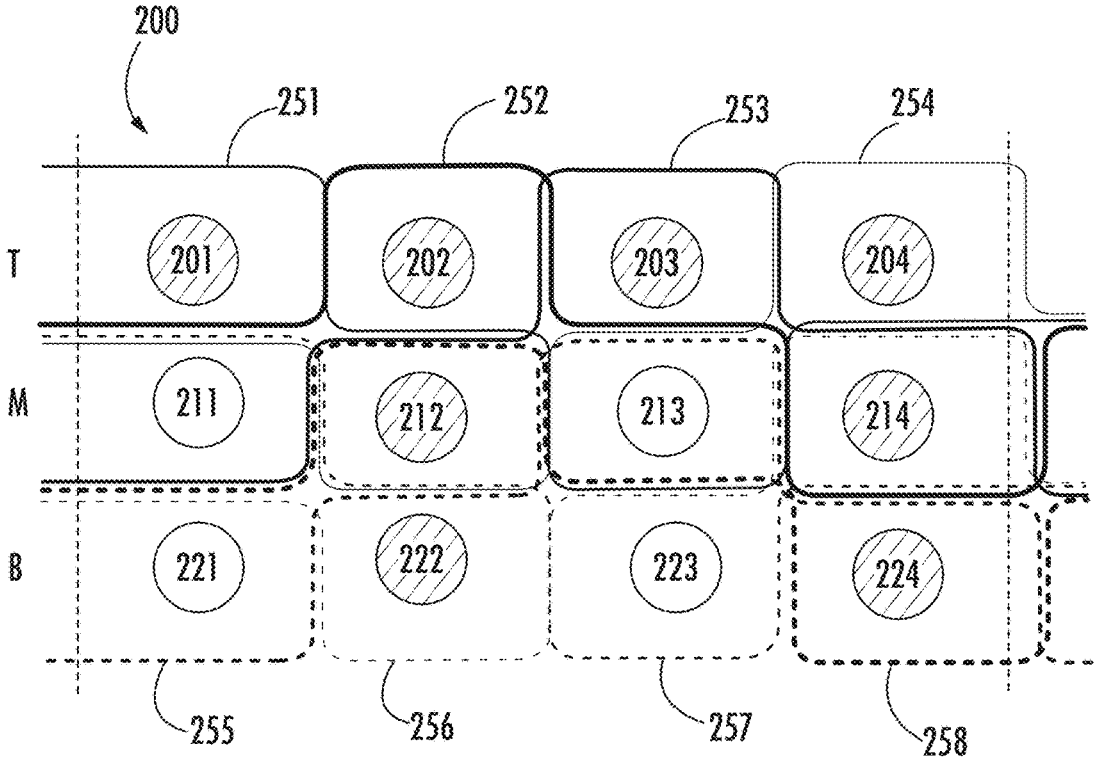

FIG. 2B illustrates a fiber cement felt 200 which includes the same repeat unit shown in FIG. 2A, i.e., four top (T) MD yarns (201-204), four middle (M) MD yarns (211-214), four bottom (B) MD yarns (221-224), four upper CMD yarns (251-254) and four lower CMD yarns (255-258) interwoven in a regular pattern with the top, middle and bottom MD yarns (201-204, 211-214, 221-224).

Each of the upper CMD yarns (251-254) interweaves with the top MD yarns (201-204) and middle MD yarns (211-214) and each of the lower CMD yarns (255-258) interweave with the middle MD yarns (211-214) and bottom MD yarns (221-224) in the same predetermined weave pattern as illustrated in FIG. 2A. Similar to the fiber cement felt 100 shown in FIG. 2A, the top MD yarns (201-204) comprise effect yarns (cross-hatched). However, rather than all the middle MD yarns (111-114) being linear yarns (not cross-hatched) and all the bottom MD yarns (121-124) being effect yarns (cross-hatched) (see FIG. 2A), the middle MD yarns (211-214) and bottom MD yarns (221-224) of the fiber cement felt 200 shown in FIG. 2B both comprise effect yarns (cross-hatched) and linear yarns (not cross-hatched) arranged in an alternating sequence. Those skilled in this art will recognize that other types of weaves can be employed in the fiber cement felt 200.

Figure 2C:
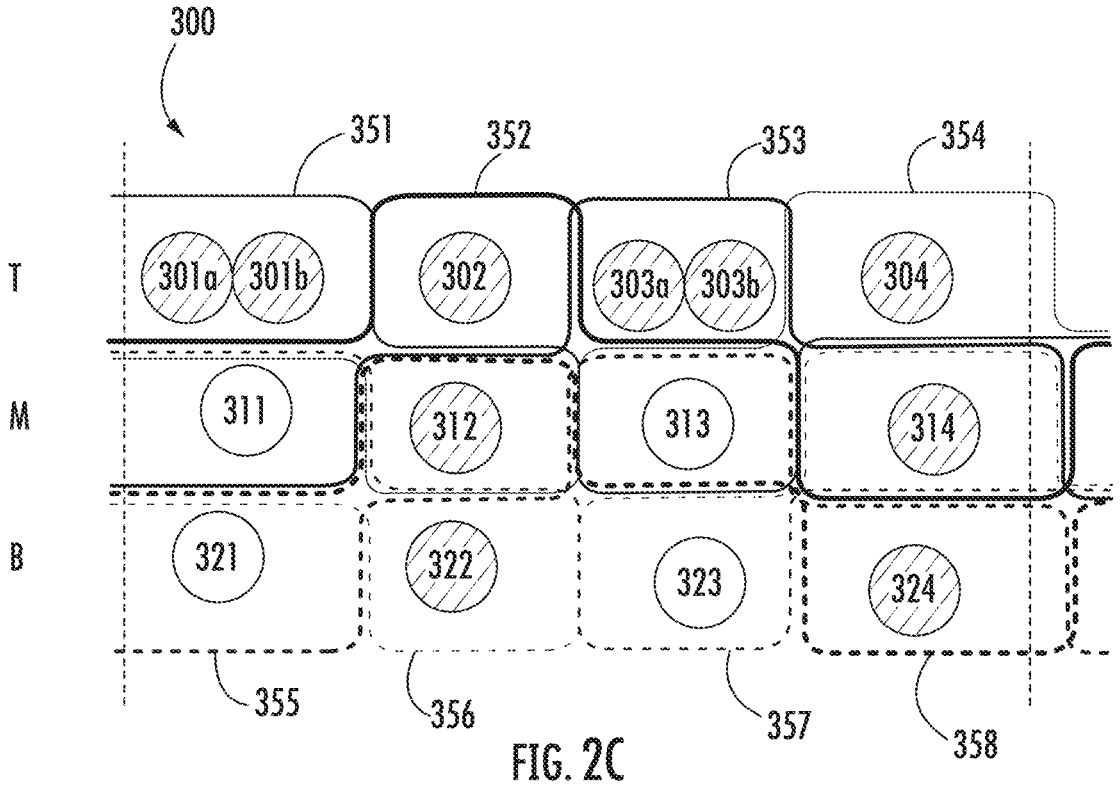

FIG. 2C illustrates a fiber cement felt 300 where the repeat unit includes six top (T) MD yarns (301-304), four middle (M) MD yarns (311-314), four bottom (B) MD yarns (321-324), four upper CMD yarns (351-354) and four lower CMD yarns (355-358) interwoven in a regular pattern with the top, middle and bottom MD yarns (301-304, 311-314, 321-324). The top MD yarns (301-304) comprise effect yarns (cross-hatched), where at least some of the effect yarns are woven in pairs (301*a,b*, 303*a,b*). The middle MD yarns (311-314) and bottom MD yarns (321-324) comprise both effect yarns (cross-hatched) and linear yarns (not cross-hatched) in an alternating sequence as seen in FIG. 2B. FIG. 2C illustrates the same configuration of MD yarns as FIG. 2B with the exception that at least some of the effect yarns comprising the top MD yarns (301-304) are woven in pairs (301*a,b*, 303*a,b*).

Each of the upper CMD yarns (351-354) interweaves with the top MD yarns (301-304) and middle MD yarns (311-314) in a predetermined weave pattern. The upper CMD yarns pass over a pair top MD yarn, pass under the adjacent top MD yarn but above the middle MD yarn directly below, pass under the next adjacent middle MD yarn but above the bottom MD yarn directly below, and pass over the next adjacent middle MD yarn but below the top MD yarn directly above. As an example, CMD yarn (351) passes over a pair of top MD yarns (301*a,b*), passes under the adjacent top MD yarn (302) but above the middle MD yarn (312) directly below, passes, under the next adjacent middle MD yarn (313) but above the bottom MD yarn (323) directly below, and passes over the next adjacent middle MD yarn (314) but below the top MD yarn (304) directly above. The remaining upper CMD yarns (352-354) follow the same pattern as upper CMD yarn (351) but are each are offset by one top MD yarn or one pair of top MD yarns.

Each of the lower CMD yarns (355-358) interweaves the middle MD yarns (311-314) and bottom MD yarns (321-324) in the same manner as described above with respect to FIG. 2A and FIG. 2B. Those skilled in this art will recognize that other types of weaves can be employed in the fiber cement felt 300.

Figure 2D:
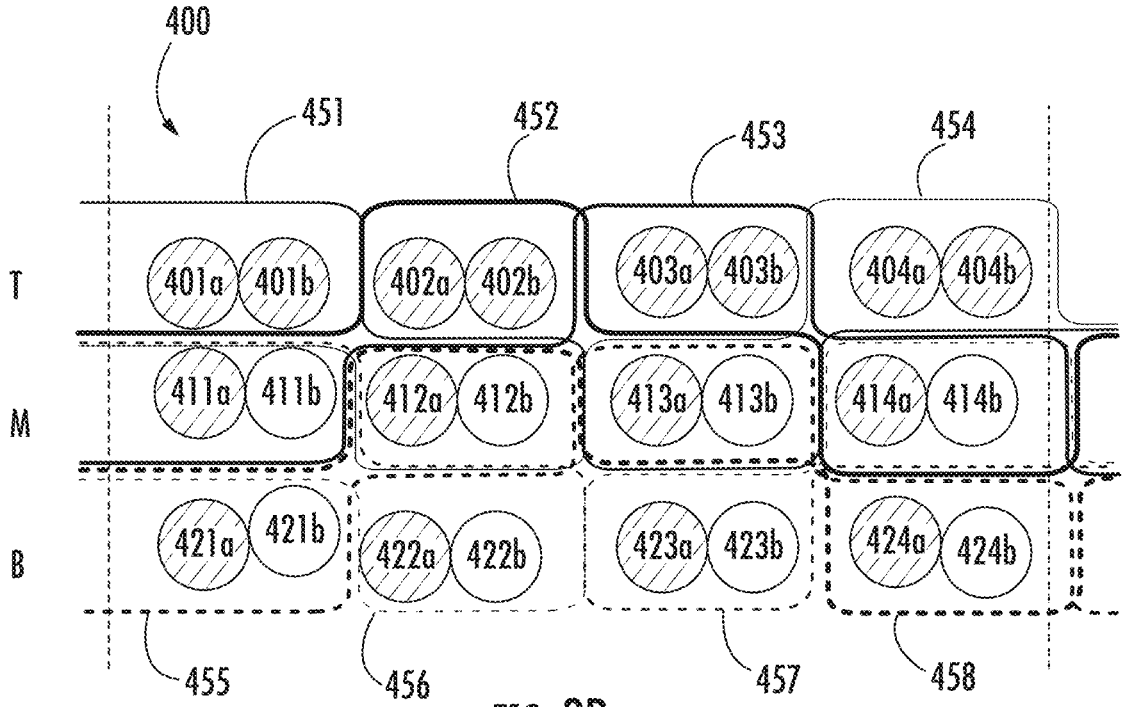

FIG. 2D illustrates a fiber cement felt 400 where the repeat unit includes eight top (T) MD yarns (401*a,b*-404*a,b*), eight middle (M) MD yarns (411*a,b*-414*a,b*), eight bottom (B) MD yarns (421*a,b*-424*a,b*), four upper CMD yarns (451-454) and four lower CMD yarns (455-458) interwoven in a regular pattern with the top, middle and bottom MD yarns (401*a,b*-404*a,b*, 411*a,b*-414*a,b*, 421*a,b*-424*a,b*). The top MD yarns (401*a,b*-404*a,b*) comprise effect yarns (cross-hatched), where at least some of the effect yarns are woven in pairs. The middle MD yarns (411*a,b*-414*a,b*)

and bottom MD yarns (421*a,b*-424*a,b*) comprise effect yarns (cross-hatched) and linear yarns (not cross-hatched), where at least some of the effect yarns (411*a*, 412*a*, 413*a*, 414*a*, 421*a*, 422*a*, 423*a*, 424*a*) are woven in pairs with linear yarns (411*b*, 412*b*, 413*b*, 414*b*, 421*b*, 422*b*, 423*b*, 424*b*).

FIG. 2D illustrates the same configuration of MD yarns as FIG. 2B with the exception that the top MD yarns (401*a,b*-404*a,b*), middle MD yarns (411*a,b*-414*a,b*), and bottom MD yarns (421*a,b*-424*a,b*) are woven in pairs. Each of the upper CMD yarns (451-454) interweaves with the top MD yarns (401*a,b*-404*a,b*) and middle MD yarns (411*a,b*-414*a,b*) in a predetermined weave pattern. The upper CMD yarns pass over a pair of top MD yarns, pass under the pair of adjacent top MD yarns but above the pair of middle MD yarns directly below, pass under the next pair of adjacent middle MD yarns but above the pair of bottom MD yarns directly below, and pass over the next pair of adjacent middle MD yarns but below the pair of top MD yarns directly above. As an example, CMD yarn (451) passes over a pair of top MD yarns (401*a,b*), passes under the pair of adjacent top MD yarns (402*a,b*) but above the pair of middle MD yarns (412*a,b*) directly below, passes under the next pair of adjacent middle MD yarns (413*a,b*) but above the pair of bottom MD yarns (423*a,b*) directly below, and passes over the next pair of adjacent middle MD yarns (414*a,b*) but below the pair of top MD yarns (404*a,b*) directly above. The remaining upper CMD yarns (452-454) follow the same pattern as upper CMD yarn (451) but are each are offset by one pair of top MD yarns.

Each of the lower CMD yarns (455-458) interweaves the middle MD yarns (411*a,b*-414*a,b*) and bottom MD yarns (421*a,b*-424*a,b*) in a predetermined weave pattern. The lower CMD yarns pass under a pair of bottom MD yarns, pass over the next pair of adjacent bottom MD yarns but under the pair of middle MD yarns directly above, pass over the next pair of adjacent middle MD yarns but under the pair of top MD yarns directly above, and pass under the next pair of adjacent middle MD yarns but over the pair of bottom MD yarns directly below. As an example, CMD yarn (455) passes under a pair of bottom MD yarns (421*a,b*), passes over the next pair of adjacent bottom MD yarns (422*a,b*) but under the pair of middle MD yarns (412*a,b*) directly above, and passes over the next pair of adjacent middle MD yarns (413*a,b*) but under the pair of top MD yarns (403*a,b*) directly above, passes under the next pair of adjacent middle MD yarns (414*a,b*) but over the bottom MD yarns (424*a,b*) directly below. The remaining lower CMD yarns (456-458) follow the same pattern as lower CMD yarn (455) but are each offset by one pair of bottom MD yarns. Those skilled in this art will recognize that other types of weaves can be employed in the fiber cement felt 400.

Figure 2E:
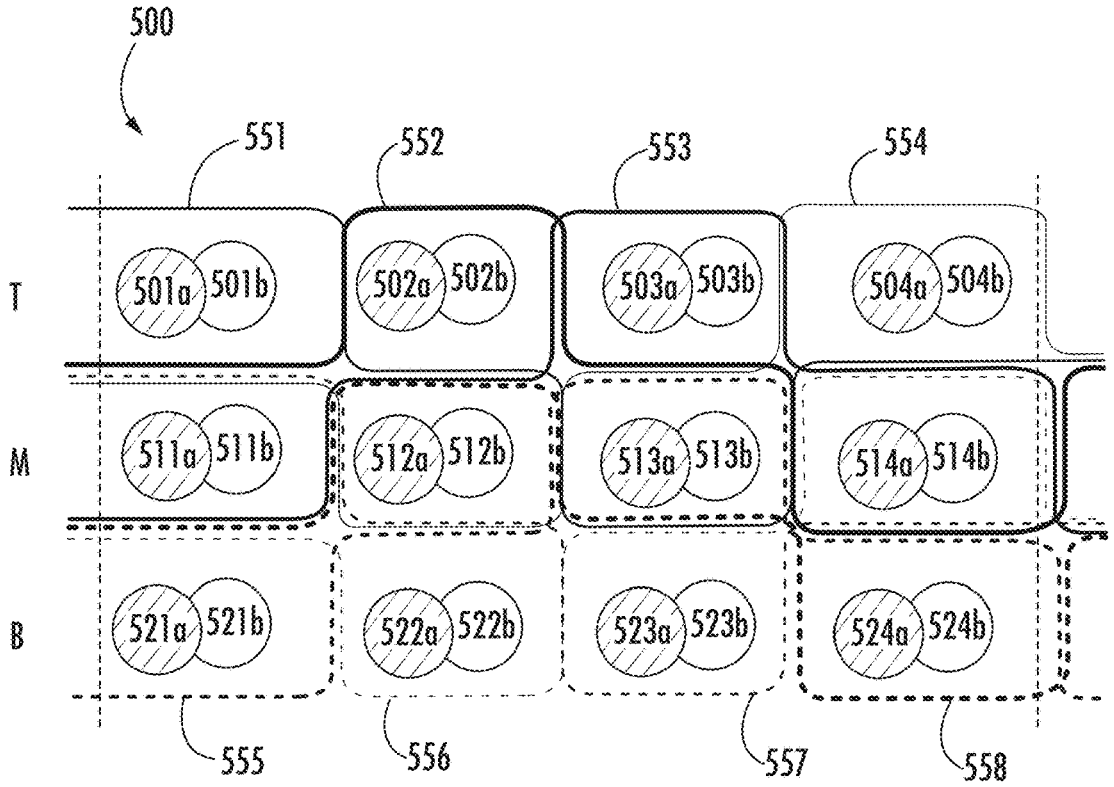

FIG. 2E illustrates a fiber cement felt 500 where the repeat unit includes eight top (T) MD yarns (501*a,b*-504*a,b*), eight middle (M) MD yarns (511*a,b*-514*a,b*), eight bottom (B) MD yarns (521*a,b*-524*a,b*), four upper CMD yarns (551-554) and four lower CMD yarns (555-558) interwoven in a regular pattern with the top, middle and bottom MD yarns (501*a,b*-504*a,b*, 511*a,b*-514*a,b*, 521*a,b*-524*a,b*). The top MD yarns (501*a,b*-504*a,b*), middle MD yarns (511*a,b*-514*a,b*) and bottom MD yarns (521*a,b*-524*a,b*) comprise effect yarns (cross-hatched) and linear yarns (not cross-hatched), where at least some of the effect yarns (501*a*, 502*a*, 503*a*, 504*a*, 511*a*, 512*a*, 513*a*, 514*a*, 521*a*, 522*a*, 523*a*, 524*a*) are woven in pairs with linear yarns (501*b*, 502*b*, 503*b*, 504*b*, 511*b*, 512*b*, 513*b*, 514*b*, 521*b*, 522*b*, 523*b*, 524*b*).

Each of the upper CMD yarns (551-554) interweaves with the top MD yarns (501*a,b*-504*a,b*) and middle MD yarns (511*a,b*-514*a,b*) and each of the lower CMD yarns (555-558) interweave with the middle MD yarns (511*a,b*-514*a,b*) and bottom MD yarns (521*a,b*-524*a,b*) in the same weave pattern as described above with respect to the fiber cement felt 400 illustrated in FIG. 2D. Similar to the fiber cement felt 400 shown in FIG. 2D, the middle MD yarns (411-414) comprise effect yarns (cross-hatched) and linear yarns (not cross-hatched) woven in pairs. The difference is that rather than all top MD yarns (401*a,b*-404*a,b*) being effect yarns (cross-hatched) (see FIG. 2D), the top MD yarns (501*a,b*-504*a,b*) of the fiber cement felt 500 shown in FIG. 2E comprise pairs of effect yarns (cross-hatched) and linear yarns (not cross-hatched). Those skilled in this art will recognize that other types of weaves can be employed in the fiber cement felt 500.

Figure 2F:
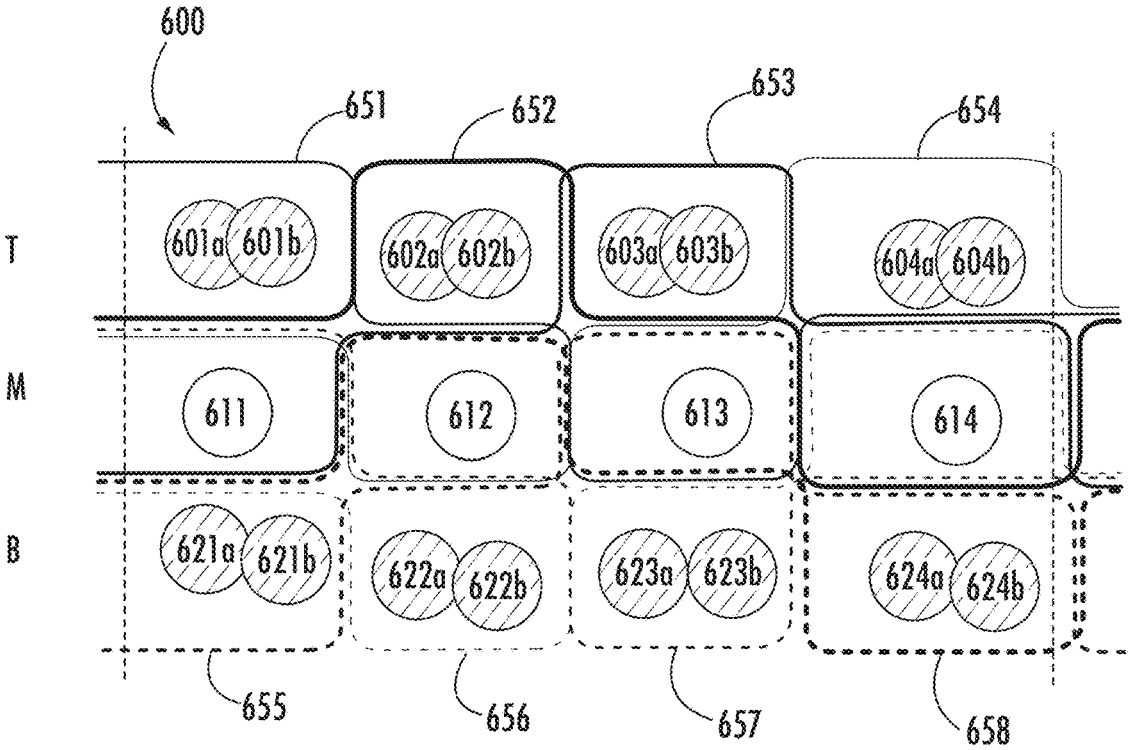

FIG. 2F illustrates a fiber cement felt 600 where the repeat unit includes eight top (T) MD yarns (601*a,b*-604*a,b*), four middle (M) MD yarns (611-614), eight bottom (B) MD yarns (621*a,b*-624*a,b*), four upper CMD yarns (651-654) and four lower CMD yarns (655-658) interwoven in a regular pattern with the top, middle and bottom MD yarns (601*a,b*-604*a,b*, 611-614, 621*a,b*-624*a,b*). The top MD yarns (601*a,b*-604*a,b*) and bottom MD yarns (621*a,b*-624*a,b*) comprise effect yarns (cross-hatched), where at least some of the effect yarns are woven in pairs. The middle MD yarns (611-614) comprise linear yarns (not cross-hatched).

FIG. 2F illustrates the same configuration of MD yarns as FIG. 2A with the exception that the top MD yarns (601*a,b*-604*a,b*) and bottom MD yarns (621*a,b*-624*a,b*) are woven in pairs. Each of the upper CMD yarns (651-654) interweaves with the top MD yarns (601*a,b*-604*a,b*) and middle MD yarns (611-614) in a predetermined weave pattern. The upper CMD yarns pass over a pair of top MD yarns, pass under the pair of adjacent top MD yarns but above the middle MD yarn directly below, pass under the next adjacent middle MD yarn but above the pair of bottom MD yarns directly below, and pass over the next adjacent middle MD yarn but below the pair of top MD yarns directly above. As an example, CMD yarn (651) passes over a pair of top MD yarns (601*a,b*), passes under the pair of adjacent top MD yarns (602*a,b*) but above the middle MD yarn (612) directly below, passes under the next adjacent middle MD yarn (613) but above the pair of bottom MD yarns (623*a,b*) directly below, passes over the next adjacent middle MD yarn (614) but below the pair of top MD yarns (604*a,b*) directly above. The remaining upper CMD yarns (652-654) follow the same pattern as upper CMD yarn (651) but are each are offset by one pair of top MD yarns.

Each of the lower CMD yarns (655-658) interweaves the middle MD yarns (611-614) and bottom MD yarns (621*a,b*-624*a,b*) in a predetermined weave pattern. The lower CMD yarns pass under a pair of bottom MD yarns, pass over the next pair of adjacent bottom MD yarns but under the middle MD yarn directly above, pass over the next adjacent middle MD yarn but under the pair of top MD yarns directly above, and pass under the next adjacent middle MD yarn but over the pair of bottom MD yarns directly below. As an example, CMD yarn (655) passes under a pair of bottom MD yarns (621*a,b*), and passes over the next pair of adjacent bottom MD yarns (622*a,b*) but under the middle MD yarn (612) directly above, passes over the next adjacent middle MD yarn (613) but under the pair of top MD yarns (603*a,b*) directly above, passes under the next adjacent middle MD yarn (614) but over the bottom MD yarns (624*a,b*) directly below. The remaining lower CMD yarns (656-658) follow the same pattern as lower CMD yarn (655) but are each offset by one pair of bottom MD yarns. Those skilled in this art will recognize that other types of weaves can be employed in the fiber cement felt 600.

Figure 3A:
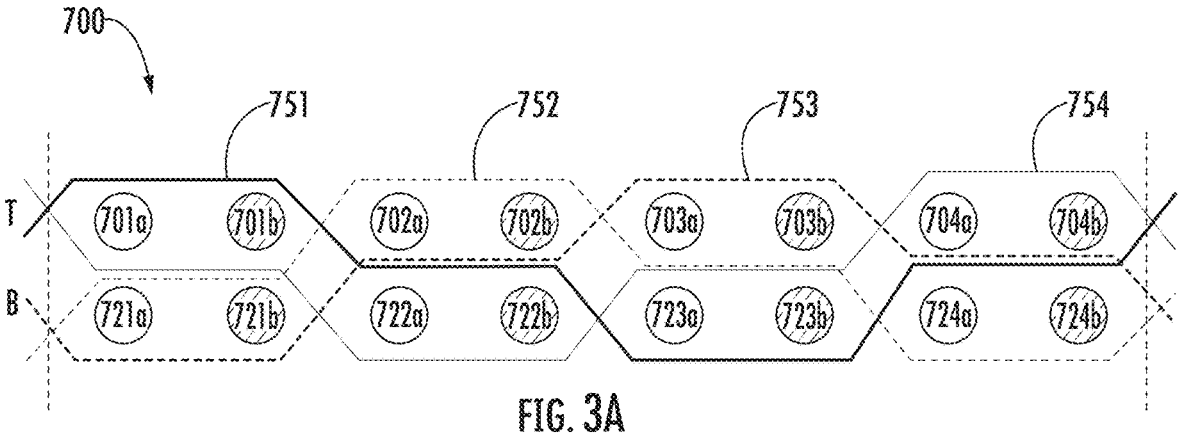
FIGS. 3A-3C are schematic section views of fiber cement felts according to embodiments of the present invention with repeats units that include top and bottom machine direction yarns and upper and lower cross-machine direction yarns.
Figure 3B:
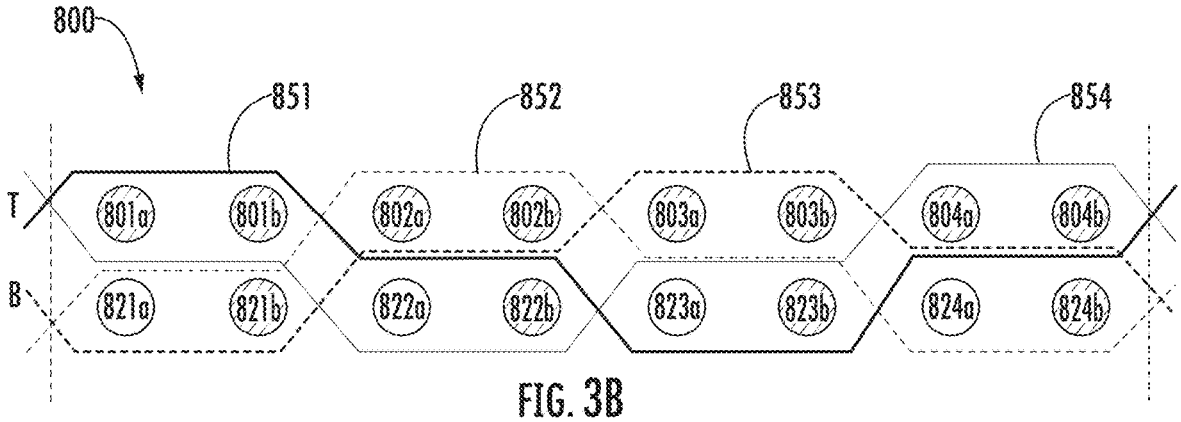
Figure 3C:
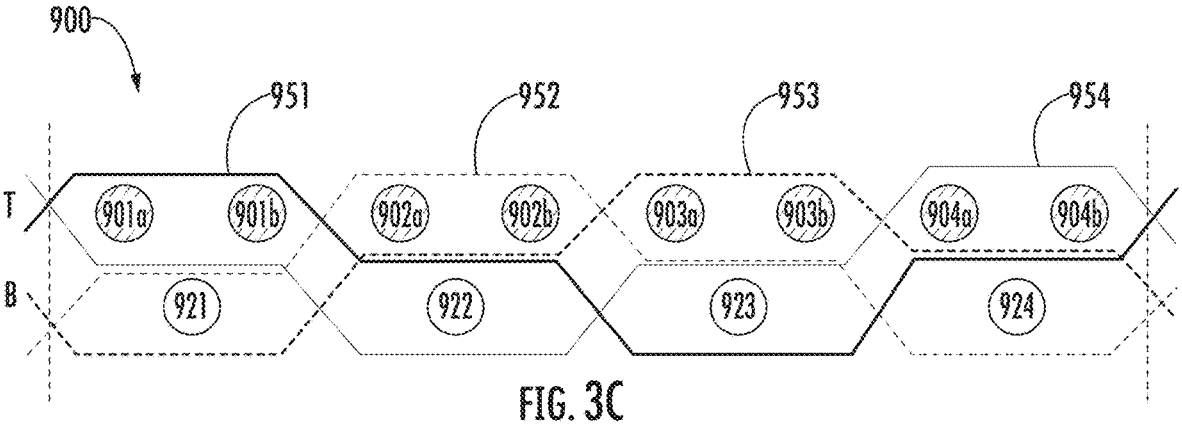

FIGS. 3A-3C illustrate enlarged sections of fiber cement felt according to alternative embodiments. Referring first to FIG. 3A, shown therein is a fiber cement felt 700 where the repeat unit includes eight top (T) MD yarns (701*a,b*-704*a,b*), eight bottom (B) MD yarns (721*a,b*-724*a,b*), and four CMD yarns (751-754) interwoven in a regular pattern with the top MD yarns (701*a,b*-704*a,b*) and bottom MD yarns (721*a,b*-724*a,b*) is shown. The top MD yarns (701*a,b*-704*a,b*) and the bottom MD yarns (721*a,b*-724*a,b*) comprise effect yarns (701*b*, 702*b*, 703*b*, 704*b*, 721*b*, 722*b*, 723*b*, 724*b*) woven in pairs with linear yarns (701*a*, 702*a*, 703*a*, 704*a*, 721*a*, 722*a*, 723*a*, 724*a*).

Each of the CMD yarns (751-754) interweaves with the top MD yarns (701*a,b*-704*a,b*) and bottom MD yarns (721*a,b*-724*a,b*) in a predetermined weave pattern. The CMD yarns that interweave with the top and middle MD yarns pass over a pair of top MD yarns, pass under the adjacent pair of top MD yarns but above the pair of bottom MD yarns directly below, pass under the adjacent pair of bottom MD yarns, and pass over the next adjacent pair of bottom MD yarns but below the pair of top MD yarns directly above. As an example, CMD yarn (751) passes over a pair of top MD yarns (701*a,b*), passes under the adjacent pair of top MD yarns (702*a,b*) but above the pair of bottom MD yarns (722*a,b*) directly below, passes under the adjacent pair of bottom MD yarns (723*a,b*), and passes over the adjacent pair of bottom MD yarns (724*a,b*) but below the pair of top MD yarn (704*a,b*) directly above. The remaining CMD yarns (752-754) follow the same pattern as CMD yarn (751) but are each offset by one pair of top MD yarn. Those skilled in this art will recognize that other types of weaves can be employed in the fiber cement felt 700.

FIG. 3B illustrates a fiber cement felt 800 which includes the same repeat unit shown in FIG. 3A, i.e., eight top (T) MD yarns (801*a,b*-804*a,b*), eight bottom (B) MD yarns (821*a,b*-824*a,b*), and four CMD yarns (851-854) interwoven in a regular pattern with the top MD yarns (801*a,b*-804*a,b*) and bottom MD yarns (821*a,b*-824*a,b*). The top MD yarns (801*a,b*-804*a,b*) comprise effect yarns, where at least some of the effect yarns are woven in pairs. The bottom MD yarns (821*a,b*-824*a,b*) comprise effect yarns (821*b*, 822*b*, 823*b*, 824*b*) woven in pairs with linear yarns (821*a*, 822*a*, 823*a*, 824*a*). Similar to the fiber cement felt 700 shown in FIG. 3A, the bottom MD yarns (821-824) comprise effect yarns (cross-hatched) and linear yarns (not cross-hatched) woven in pairs. The difference is that rather, than the top MD yarns (701-704) being effect yarns (cross-hatched) and linear yarns (not cross-hatched) (see FIG. 3A), the top MD yarns (801-804) of the fiber cement felt 800 shown in FIG. 3B comprise only effect yarns (cross-hatched) woven in pairs. Those skilled in this art will recognize that other types of weaves can be employed in the fiber cement felt 800.

FIG. 3C illustrates a fiber cement felt 900 where the repeat unit includes eight top (T) MD yarns (901*a,b*-904*a,b*), four bottom (B) MD yarns (921-924), and four CMD yarns (951-954) interwoven in a regular pattern with the top MD yarns (901*a,b*-904*a,b*) and bottom MD yarns (921-924). The top MD yarns (901*a,b*-904*a,b*) comprise effect yarns (cross-hatched) woven in pairs. The bottom MD yarns (921-924) comprise linear yarns (not cross-hatched).

Each of the CMD yarns (951-954) interweaves with the top MD yarns (901*a,b*-904*a,b*) and bottom MD yarns (921-924) in a similar predetermined weave pattern as illustrated in FIG. 3A and FIG. 3B. The differences in fiber cement felt 900 shown in FIG. 3C are the bottom MD yarns (921-924) are not woven in pairs and do not comprise effect yarns (cross-hatched). Those skilled in this art will recognize that other types of weaves can be employed in the fiber cement felt 900.

Those skilled in this art will understand that other numbers of MD and/or CMD yarns may be employed for any of the weave patterns described above. The MD yarns of the present invention typically have a diameter between about 0.5 mm and about 1.1 mm. The CMD yarns typically have a diameter between about 0.3 mm and about 0.7 mm.

Figure 4A:
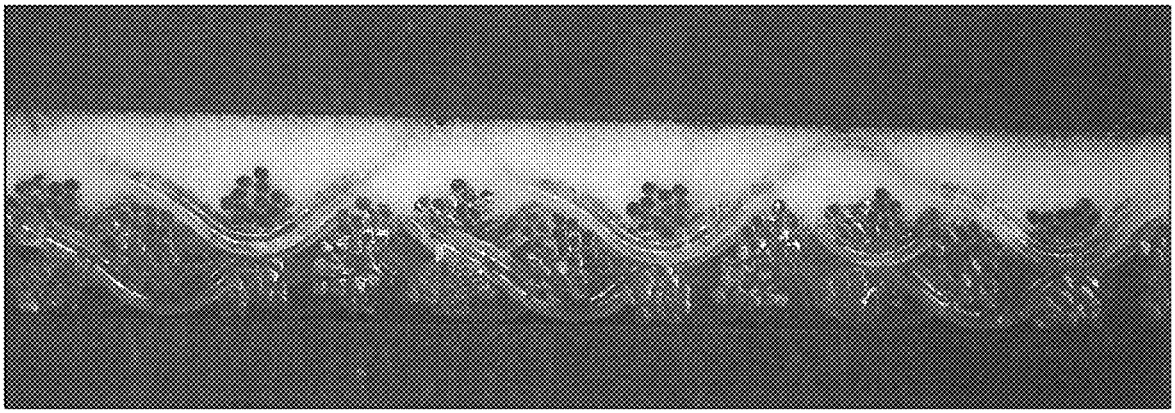
FIGS. 4A-4B are cross-sectional views of fiber cement felts according to embodiments of the present invention.
Figure 4B:
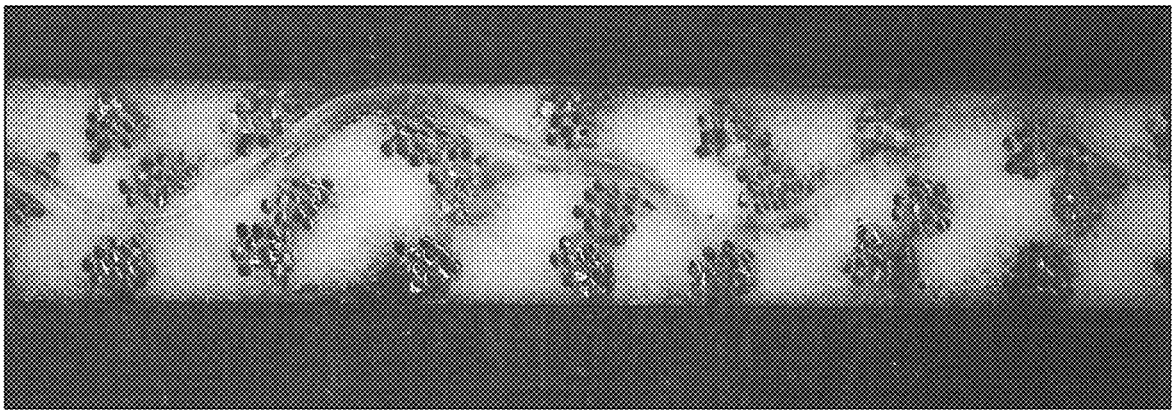
Figure 5A:
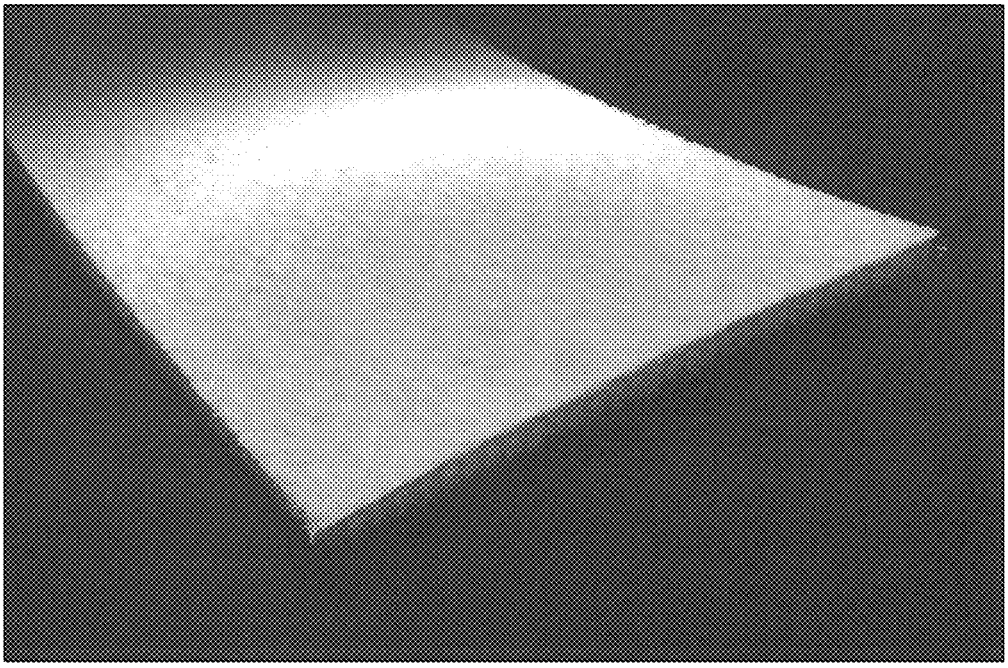
FIG. 5A is a top perspective view a fiber cement felt of the present invention.
Figure 5B:
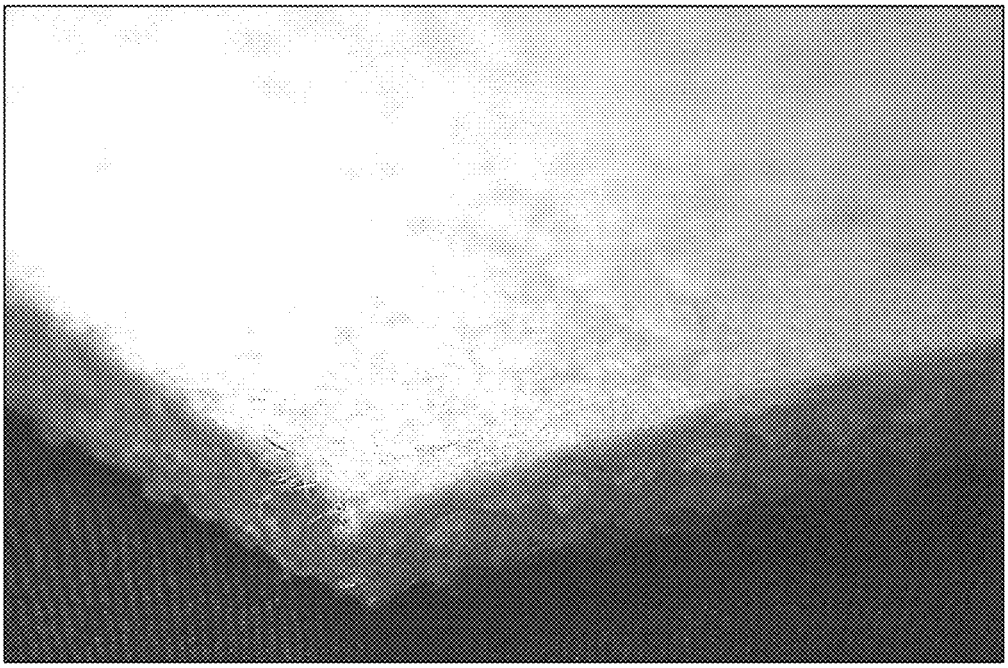
FIG. 5B is an enlarged top perspective view of the top surface and cross-section of the fiber cement felt shown in FIG. 5A.

FIGS. 4A and 4B and FIGS. 5A and 5B show examples of different fiber cement felts incorporating some of the embodiments of the present invention. FIG. 4A is a cross-sectional view of a fiber cement felt 1000 of the present invention where the top MD yarns comprise effect yarns. FIG. 4B is a cross-sectional view a fiber cement felt 1100 of the present invention where the top, middle and bottom MD yarns comprise effect yarns. FIG. 5A shows the top surface of the fiber cement felt 1200 of the present invention. FIG. 5B shows a top perspective view of the surface and cross-section of the fiber cement felt 1200 shown in FIG. 5A.

A fiber cement felt with effect yarns such as those described above may have improved properties over existing fiber cement felts, for example, higher tensile strength in both directions. Additional improvements over existing fiber cement felts include no batt production is necessary, no needling step—no destruction of MD and CMD yarns during the needling process, only two machines are needed to create (weaving loom and finishing machine), no pre-finishing is needed, and no storage between two operation steps during production.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. A fiber cement felt comprising:

a base fabric comprising repeat units, each of which includes a plurality of top, middle, and bottom machine direction (MD) yarns and a plurality of cross-machine direction (CMD) yarns interwoven with the plurality of top, middle, and bottom MD yarns in a predetermined weave pattern, wherein the plurality of top, middle, and bottom MD yarns comprises a plurality of effect yarns and a plurality of linear yarns, wherein at least some of the top MD yarns are effect yarns, and at least some of the bottom MD yarns are effect yarns; and wherein at least some of the effect yarns in the plurality of middle and bottom MD yarns are woven in pairs with the linear yarns.

2. The fiber cement felt of claim 1, wherein the plurality of effect yarns is selected from the group consisting of chenille yarns, DREF yarns, Bouclé yarns, and knot yarns, and wherein the plurality of linear yarns comprises monofilament or twisted monofilament yarns.

3. The fiber cement felt of claim 1, wherein the plurality of CMD yarns comprises monofilament or twisted monofilament yarns.

4. The fiber cement felt of claim 1, wherein at least some of the effect yarns in the plurality of top MD yarns are woven in pairs.

5. The fiber cement felt of claim 1, wherein the plurality of top, middle, and bottom MD yarns have a diameter of between about 0.5 mm and about 1.1 mm and the plurality of CMD yarns have a diameter of between about 0.3 mm and about 0.7 mm.

6. A fiber cement felt comprising:

a base fabric comprising repeat units, each of which includes a plurality of top, middle, and bottom MD yarns and a plurality of CMD yarns interwoven with the plurality of top, middle, and bottom MD yarns in a predetermined weave pattern, wherein the plurality of top, middle, and bottom MD yarns comprises a plurality of effect yarns and a plurality of linear yarns, wherein at least some of the top MD yarns are woven in pairs of effect yarns; and wherein at least some of the effect yarns in the plurality of bottom MD yarns are woven in pairs.

7. The fiber cement felt of claim 6, wherein the plurality of effect yarns is selected from the group consisting of chenille yarns, DREF yarns, Boucle yarns, and knot yarns, and wherein the plurality of linear yarns comprises monofilament or twisted monofilament yarns.

8. The fiber cement felt of claim 6, wherein at least some of the effect yarns in the plurality of middle and bottom MD yarns are woven in pairs with the linear yarns.

9. The fiber cement felt of claim 6, wherein the plurality of top, middle, and bottom MD yarns have a diameter of between about 0.5 mm and about 1.1 mm and the plurality of CMD yarns have a diameter of between about 0.3 mm and about 0.7 mm.

10. A fiber cement felt comprising:

a base fabric comprising repeat units, each of which includes a plurality of top and bottom machine direction (MD) yarns and a plurality of cross-machine direction (CMD) yarns interwoven with the plurality of top and bottom MD yarns in a predetermined weave pattern, wherein the plurality of top and bottom MD yarns comprises a plurality of effect yarns and a plurality of linear yarns, wherein at least some of the top MD yarns are effect yarns and at least some of the bottom MD yarns are effect yarns; and wherein at least some of the effect yarns in the plurality of top and bottom MD yarns are woven in pairs with the linear yarns.

11. The fiber cement felt of claim 10, wherein the plurality of effect yarns is selected from the group consisting of chenille yarns, DREF yarns, Bouclé yarns, and knot yarns, and wherein the plurality of linear yarns comprises monofilament or twisted monofilament yarns.

12. The fiber cement felt of claim 10, wherein the plurality of CMD yarns comprises monofilament or twisted monofilament yarns.

13. The fiber cement felt of claim 10, wherein at least some of the effect yarns in the plurality of top MD yarns are woven in pairs and at least some of the effect yarns in the plurality of bottom MD yarns are woven in pairs with the linear yarns.

14. The fiber cement felt of claim 10, wherein the plurality of top and bottom MD yarns have a diameter of between about 0.5 mm and about 1.0 mm and the plurality of CMD yarns have a diameter of between about 0.3 mm and about 0.7 mm.

15. A fiber cement felt comprising:

a base fabric comprising repeat units, each of which includes a plurality of top and bottom MD yarns and a plurality of CMD yarns interwoven with the plurality of top and bottom MD yarns in a predetermined weave pattern, wherein the plurality of top and bottom MD yarns comprises a plurality of effect yarns and a plurality of linear yarns, wherein at least some of the top MD yarns are effect yarns and at least some of the bottom MD yarns are effect yarns, wherein at least some of the effect yarns in the plurality of top MD yarns are woven in pairs.

16. The fiber cement felt of claim 15, wherein the plurality of effect yarns is selected from the group consisting of chenille yarns, DREF yarns, Bouclé yarns, and knot yarns, and wherein the plurality of linear yarns comprises monofilament or twisted monofilament yarns.

17. The fiber cement felt of claim 15, wherein the plurality of CMD yarns comprises monofilament or twisted monofilament yarns.

18. A method of forming a fiber cement article, comprising the steps of:

(a) providing a fiber cement felt, the fiber cement felt comprising: a base fabric comprising repeat units, each of which includes a plurality of top, middle, and bottom MD yarns and a plurality of CMD yarns interwoven with the plurality of top, middle, and bottom MD yarns in a predetermined weave pattern, wherein the plurality of top, middle, and bottom MD yarns comprises a plurality of effect yarns and a plurality of linear yarns, wherein at least some of the top MD yarns are effect yarns, and at least some of the bottom MD yarns are effect yarns;

(b) positioning the fiber cement felt on a series of support rolls of a fiber cement forming machine;

(c) depositing a fiber cement slurry on the fiber cement felt; and (d) removing moisture from the slurry to form a fiber cement web.

19. The fiber cement felt of claim 18, wherein the plurality of effect yarns is selected from the group consisting of chenille yarns, DREF yarns, Bouclé yarns, and knot yarns, and wherein the plurality of linear yarns comprises monofilament or twisted monofilament yarns.

20. The fiber cement felt of claim 18, wherein the plurality of CMD yarns comprises monofilament or twisted monofilament yarns.

21. The fiber cement felt of claim 18, wherein at least some of the effect yarns in the plurality of top MD yarns are woven in pairs.

22. The fiber cement felt of claim 18, wherein at least some of the effect yarns in the plurality of middle and bottom MD yarns are woven in pairs with the linear yarns.

* * * * *